US005239908A

United States Patent [19]

Attias

[11] Patent Number: 5,239,908

[45] Date of Patent: Aug. 31, 1993

[54] NECK CONSTRUCTION OF A MUSICAL INSTRUMENT

[76] Inventor: James Attias, 19470 NW. 59th Ave., Miami, Fla. 33015

[21] Appl. No.: 821,407

[22] Filed: Jan. 15, 1992

[51] Int. Cl.[5] ..... G10D 1/08

[52] U.S. Cl. ..... 84/267; 84/293; 84/328

[58] Field of Search ..... 84/267, 293, 314 R, 84/328

[56] References Cited

U.S. PATENT DOCUMENTS

| | | | |
|---|---|---|---|
| 1,807,746 | 6/1931 | Moor . | |
| 2,816,469 | 4/1954 | Gossom | 84/293 |
| 3,091,150 | 5/1963 | Sceusa | 84/293 |
| 3,392,618 | 3/1966 | Pelensky | 84/267 |
| 3,443,018 | 5/1969 | Krebs | 84/1.16 |
| 4,538,497 | 9/1985 | Smith | 84/291 |
| 4,616,550 | 10/1986 | LaCroix et al. | 84/173 |
| 4,759,250 | 7/1988 | Lieber | 84/293 |
| 4,765,219 | 8/1988 | Alm | 84/1.15 |
| 4,953,435 | 9/1990 | Chapman | 84/293 |

FOREIGN PATENT DOCUMENTS 575158 4/1993 Fed. Rep. of Germany .

*Primary Examiner*—Michael L. Gellner
*Assistant Examiner*—P. Stanzione

[57] ABSTRACT

An improved construction for the neck of a musical instrument, such as a guitar, is disclosed herein. The bottom surface of the neck of a musical instrument opposite to the fret surface, is provided with one or more elongated depressions extending along the longitudinal axis of the neck of the instrument. Each of the one or more longitudinal depressions being straight and shaped in a generally concave configuration adapted to fit a player's thumb, with the depression being located centrally or offset to one longitudinal side or the other of the neck of the instrument. In other embodiments, side depressions are provided between the central depression and an extending side edge of the instrument neck.

20 Claims, 3 Drawing Sheets

NECK CONSTRUCTION OF A MUSICAL INSTRUMENT

CROSS REFERENCE TO RELATED APPLICATIONS

This application is related to U.S. patent application Ser. No. 643,329 filed Jan. 22, 1991 entitled: Neck Construction of a Musical Instrument.

BACKGROUND OF THE INVENTION

1. Field of the Invention

This invention relates in general to musical instruments having an elongated neck portion attached to a main body portion and in particular to the construction of the neck portion of musical instruments around which the player of the musical instrument wraps his hand to hold the instrument and to apply finger pressure thereto to vary the tonal sound or the pitch of the sound produced by the musical instrument, particularly acoustic and electric guitars and basses.

2. Description of the Prior Art

A great many of the modern-day musical instruments, as well as a great many of the recent past and even the antique musical instruments, comprise a main body portion and an elongated neck extending from the body portion. In general, most of such instruments include a number of strings extending between the end of the neck of the instrument and an anchor point of the strings on the body portion of the instrument. Typically, the end of the neck portion to which the strings are attached, includes means for separately tightening each of the strings in order to achieve the proper pitch produced when a string is caused to vibrate. For example, such musical instruments may comprise a guitar, both electrical and acoustical, a bass guitar, and other like stringed musical instruments.

Once such stringed instruments are properly tuned by appropriately tightening each of the strings, the instrument is ready to be played. Playing of the stringed instruments not only includes causing the strings to vibrate by finger strumming or picking of the strings but also by varying the effective length of the strings by the player. By sliding his hand along the length of the neck of the instrument and by pressing the strings between his fingers and the instrument neck, the musician varies the effective length of the strings and thereby changes the pitch of the sound produced by the strings. In either event, the player must hold the instrument at the neck end by positioning the same between his extended fingers and thumb and his hand bent at the wrist.

Typically, the construction of the neck of the prior art musical instruments has a cross-sectional shape having a flat top portion and a convexly shaped or outwardly curved bottom portion which somewhat resembles the configuration of a capital letter "D". A plurality of frets, comprising raised narrow ridges, extending transverse to the neck of the instrument are spaced from each other along the length of the neck of the instrument. The strings of the instrument are positioned on the flat side of the neck, above the transverse frets, and extend along the length thereof generally parallel to each other with spaces therebetween. When positioning and playing such a stringed instrument, the player or musician positions one hand around the neck with his fingers on the string side and his thumb against the convexly curved lower surface. Then, by squeezing the one or more strings and the neck of the instrument between his thumb and one of his extending fingers either at the location of the frets or between the frets, a desired pitch of the instrument is achieved. By varying the location of his hand along the neck of the instrument and squeezing the strings at different locations, different pitches are achieved.

The positioning of a hand at the neck of the instrument and the sliding of the player's hand therealong while applying pressure to the strings between his fingers and his thumb, results in a relatively awkward position of the player's hand. It requires bending of the wrists inwardly to create an approximate right angle between the person's hand and the person's arm and with the fingers and thumb extending parallel to each other with a space therebetween. In the space therebetween, of course, is located the neck of the instrument being played. Then, the player is required to squeeze one of his extending fingers, usually his middle finger, and thumb to capture one or more strings on the upper flat side of the neck and press the same against the neck while also pressing against the curved bottom portion of the neck of the instrument. It can, therefore, be well appreciated that the position and extending fingers of the player's hand is a difficult position to maintain while correctly applying the pressure to the strings and neck of the instrument, therefore, players will often "improperly" position their thumb at a more convenient location on the convex side of the neck depending upon which string or strings are to be captured by the player's fingers. Also, depending on the type of the music to be played, a player will purposefully misposition his thumb to allow his fingers to achieve a particular location relative to the strings in order to allow the player to play a particular type of music. The prior art cross-sectional shape of the neck of the instrument does not enhance but in actuality hinders the ability of the person to position his thumb and apply pressure to the neck of the musical instrument and to the strings extending therealong.

Another method of playing a guitar involves a player sliding his hand along the center of the back of the neck of the instrument to achieve a different axial location on the neck by his hand and then rotating his hand to place his thumb at a location other than at the center of the back. The prior art guitar neck designs are not conducive to this type of playing.

Inasmuch as the overall construction of a necked musical instrument materially affects the quality of the sound produced thereby, the prior art neck construction necessarily has an effect on the sound quality of the instrument. The consistently-shaped prior art necked instruments, therefore, produce a quality of the sound though, while consistent, can be improved.

Accordingly, it is a primary object of the present invention to provide a construction of the neck of a musical instrument which allows the player of the instrument to more easily position his hand around the neck of the instrument with his thumb on one side and apply pressure to the instrument strings on the other side by his extending fingers while sliding his hand axially along the length of the neck of the instrument to vary the pitch of the sound produced by the strings.

Another object of the present invention is to provide a construction of the neck of a musical instrument whereby the fit up between a person's hand and the neck of the instrument provides for reducing of the tension in the player's hand in order to allow the player to achieve an improved musical performance.

Another object of the present invention is to provide a construction of the neck of a musical instrument whereby a musician can more conveniently position his extending fingers and thumb transverse to the longitudinal axis of the neck of the instrument, depending upon the type of music the player desires to play.

Another object of the present invention is to provide a construction of the neck of a musical instrument whereby the quality of the sound produced by the instrument is improved.

Another object of the present invention is to configure the cross-sectional shape of a neck of a musical instrument which better conforms to the space between a person's extended thumb and extended fingers when playing a musical stringed instrument and depending on where the player places his thumb.

Another object of the present invention is to configure the cross-sectional shape of a neck of a stringed musical instrument which conforms to the curvature of a person's thumb and a person's hand and thumb heel pads.

Another object of the present invention is to provide the neck of a stringed musical instrument, such as a guitar and a bass, with one or more depressions which extend along the neck of the musical instrument and thereby provide a player with a choice of the location of the one or more depressions across the width of the neck of the instrument while sliding his hand along the length of the neck of the instrument.

The above-stated objects as well as other objects which, although not specifically stated, but are intended to be included within the scope of the present invention, are accomplished by the present invention and will become apparent from the hereinafter set forth Detailed Description of the Invention, Drawings, and the Claims appended herewith.

SUMMARY OF THE INVENTION

The present invention accomplishes the above-stated objectives, as well as others, as may be determined by a fair reading and interpretation of the specification including the drawings, abstract and claims appended thereto, by providing a new and improved construction of the neck of a musical instrument comprising a guitar or a bass, which may include an acoustical or electrical guitar or an acoustical or electrical bass guitar.

One or more longitudinal depressions, concavely shaped and transverse to the longitudinal axis, extend along various locations on the non-stringed or back side of the neck of the musical instrument. The one or more longitudinally extending depressions thereby create a cross-sectional configuration of the neck of the instrument transverse to its longitudinal axis, which provides for the placement of the player's thumb, thumb heel pad and finger heel pads depending on how a particular player prefers to position his thumb and hand while pressed against one or more strings of the instrument with his extending fingers. By providing the construction of the neck of a musical instrument, above-described, the neck construction acts in conjunction with, rather than in conjunction against the natural shape of the player's hand which is positioned on the neck of the musical instrument and must slide therealong which playing the instrument. The result is a more naturally and easily played musical instrument. And, because of the construction of the neck, the sound produced by the depressions is increased in quality as compared to the same instrument not having an axial depression. A "warmer" sound is produced by a stringed instrument having one or more depressions extending the length of the neck of the instrument.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
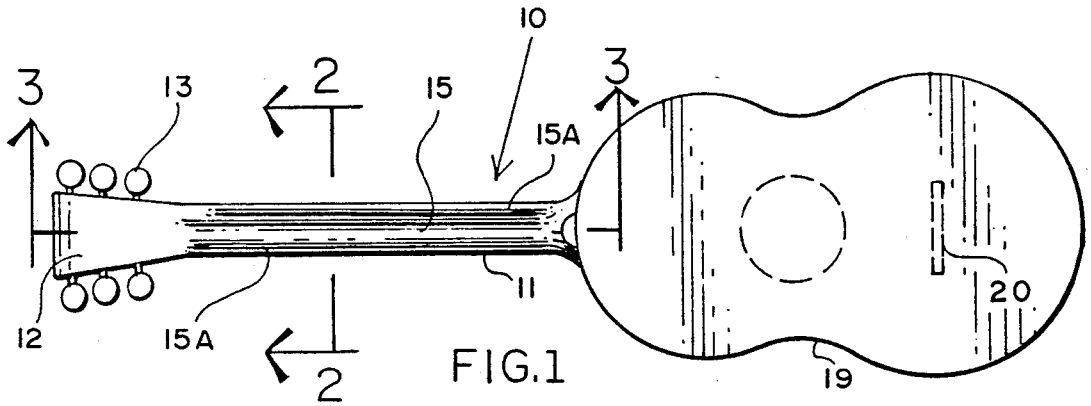
FIG. 1 is a bottom isometric view of a typical modern day stringed instrument, such as a guitar or a bass guitar, having the inventive neck configuration of the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

Reference is now made, in particular, to FIG. 1 of the drawings. FIG. 1 illustrates a back or bottom side of a typical stringed instrument 10 such as a guitar or a bass guitar having a neck member 11 attached thereto. Instrument 10 generally comprises a stringed instrument having an extending substantially straight portion of a neck member 11 integral with a tuning end member 12 having a plurality of tightening screws 13 attached thereto. One end of each of strings 14 is attached to each tightening screw 13. Neck member 11 is usually a separate member which is securely attached to a body portion 19 at the end 16 of neck member 11. The other end of each of the strings 14 is attached to a transverse support member 20 integral with the top surface of the musical instrument at body portion 19. Tightening or loosening of any of the tightening screws 13 causes an increase or decrease in the tension in a string 14 associated therewith and thereby allows a player to properly tune each string 14 as appropriate.

Figure 3:
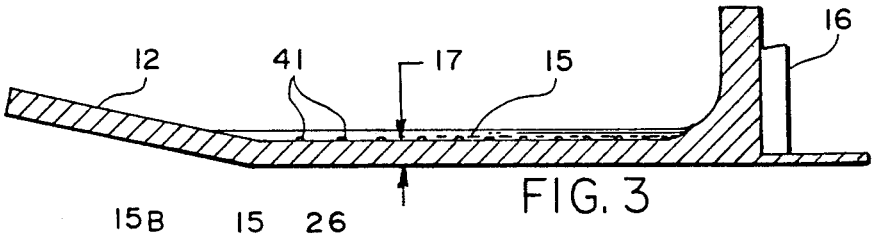
FIG. 3 is a side cross-sectional view of the neck construction of FIG. 1 taken along the line 3—3 thereof.

As seen in FIGS. 1 and 3, one or more variously positioned depressions 15, each comprising a concave depression, are provided which extend along the length of the neck 11 of the guitar 10. When viewed in cross section, with said cross section being transverse to the longitudinal axis of the neck 11 of the instrument 10, each of the one or more depressions 15 is seen to have a generally concave configuration. The shape of the one or more depressions 15 is intended to substantially coincide or mate with the convex curvature of an extending thumb of a person's hand so as to allow the same to fit naturally and comfortably within the one or more depressions 15 and to allow a player to have a comfortable thumb positioning means while sliding his hand along the length of the neck 11 of the instrument 10. It is to be noted that the direction of the extending thumb of a person's hand when playing a necked musical instrument is generally transverse to the longitudinal axis of the neck 11.

By providing one or more depressions 15 at the locations shown in FIGS. 2A, 2B, 2C, 2D, 2E, 2F and 2G of the drawings, a player of a necked musical instrument may, therefore, more conveniently and naturally extend his fingers, while positioning his thumb in the one or more depressions 15, when bending his wrist to position his hand on the neck 11 of the instrument 10 In so doing, the player creates a variously shaped "U" space between his extending fingers and thumb in a direction generally transverse to the longitudinal axis of the neck of the musical instrument (see FIGS. 5, 6 & 7), which space the neck 11 is more readily positioned with respect thereto. This allows the player to more easily assert finger pressure on one or more of the strings 14 of the instrument at a particular location along the neck 11 thereof and asserting thumb pressure at one of various locations on the underside of the neck 11 while sliding his hand along the length of the neck 11 and switching from one depression to another in order to obtain the desired musical sound of a string or strings, or to play a particular type of music.

In prototype testing of the invention, it has been found that a player may much more readily and effortlessly extend one or more fingers along the top surface 16 of the neck 11 of an instrument and with his thumb at the bottom surface of neck 11 which is provided with one or more depressions 15 shaped to substantially coincide with the curvature of a person's thumb than, for example, in prior art neck constructions where no depression is provided. The result is that a good player can play better with such a necked instrument 10 and a beginning player can play much more easily with such an instrument 10 than one of the prior art regardless of where he positions his thumb. An added unexpected benefit of the one or more depressions 15 is that the musical instrument produces a warmer and better sound whereby the quality of the sound is improved due to the change in the shape of the neck of the instrument. That is, that a prior art instrument plays like a high quality and more expensive instrument when provided with the one or more depressions 15.

In FIG. 3 of the drawings, it is seen that the one or more depressions 15 extend longitudinally along the length of the neck 11 of the musical instrument 10 for substantially the entire length of the neck 11. FIG. 3 shows that the depth of depression 15 may be substantially constant along the entire length of the neck 11 of the instrument 10. In this manner, the resulting thickness 17 of the remaining portion of the neck 11 of the instrument 10 is seen to become slightly thinner toward the tuning end 13 thereof due only to the conventional axial taper of neck 11. Although not shown, equally within the intent and scope of the invention, is that the one or more grooves 15 may vary in depth such that the remaining thickness 17 may be substantially constant along the entire length of the neck 11 of the instrument 10. Also intended within the scope of the invention is that the one or more depressions 15 and the remaining thickness 17 of the neck 11 may be both tapered in the same or opposite directions.

Figure 4:
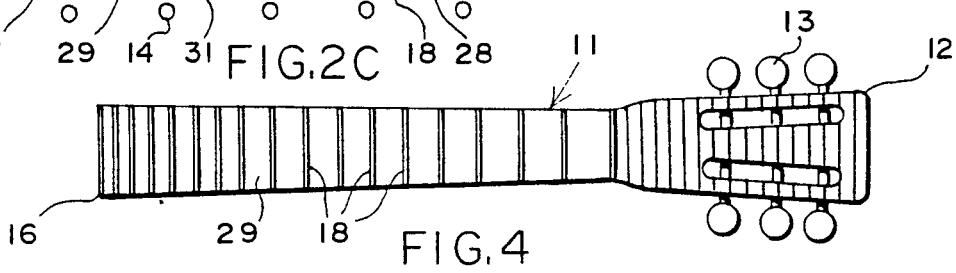
FIG. 4 is a top plane view of the neck construction of FIG. 3.

Frets 18 shown in FIG. 4, allow a player to press one or more strings 14 between a particular fret 18 and thereby change the effective length of a string 14. When a string is strummed, or caused to vibrate, a pitch is produced consistent with the effective length of the string 14. Thus, by utilizing different frets 18, the length of a string 14 changes as does its pitch when caused to vibrate. When playing a necked, stringed musical instrument 10, such as that shown in FIGS. 1 through 4 of the drawings, a person's thumb would generally extend transversely to the neck 11 within the one or more depressions 15 while one or more of his fingers would extend in the same direction as his thumb but be pressed upon one or more of strings 14 pinching the one or more strings 14 at a location between particular frets 18.

Figure 2A:
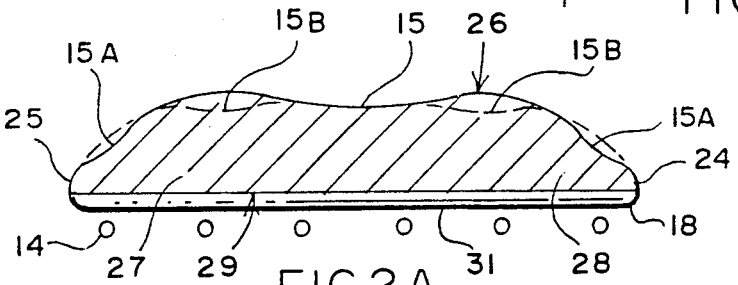
FIG. 2A is a cross-sectional, transverse view taken through the neck of the musical instrument of FIG. 1 through the line 2—2 thereof.

FIGS. 2A through 2G depict various transverse, cross-sectional shapes of a neck 11 of an instrument 10 which the present invention may embody. FIG. 2A illustrates a transverse, cross-sectional shape of a neck 11 wherein a longitudinal depression 15 is centered across the width of neck 11. The raised portions on either side of depression 15 may be of equal height or may have the raised portion nearest side edge 24 slightly lower than the raised portion nearest side edge 25. Depression 15 allows a player to place his thumb at the transverse center of the side 26 of neck 11 having the depression thereon. Another horizontal depression 15B may be provided on either side of the center depression 15. Depressions 15B, thereby allow a player to place his thumb at either of depressions 15B while his fingers press against strings located primarily at portion 28 or portion 27 of fret side 29 of neck 11. The transverse cross section illustrated in FIG. 2A may also include side depressions 15A which are located close to side edges 24 and 25 of neck 11. Side depressions 15A allow a player to even further position his fingers on strings 14 more toward the outside ends 24 and 25 of portions 27 and 28 of neck 11. The combination of depressions 15, either of 15B and either of 15A allow a player to use any of the afore-mentioned depressions or allow him to change the location of his thumb, and therefore his extending fingers when sliding his hand from neck end 12 to neck end 16, or vice versa, along neck 11.

Figure 2B:
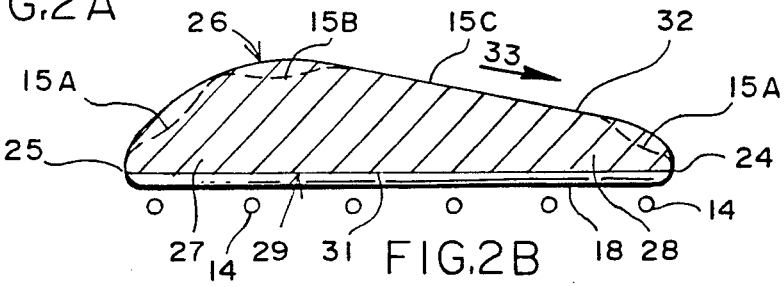
FIG. 2B is a cross-sectional, transverse view of another embodiment of a neck construction having one or more axial depressions.

In FIG. 2B, a one-half center depression 15C is provided in conjunction with a straight sloping surface 32. Thus, one-half center depression 15C ends at the geometric center of neck 11. Sloped surface 32 is sloped downward in the direction 33 of side edge 24. Side edge 24 being that side edge which is physically located uppermost as compared to side edge 25 when the guitar is being played by a right handed player. Thus, depression 15C is adapted to fit therewithin the convex portion of the thumb of the player's hand which is encircling the neck of the instrument. The sloped surface 32 and side edge 24 of the neck 11 are then positioned above the thumb of the player's hand. A side depression 15A at side 25 would be advantageous in this instance to fit therein the heel pad of the player's fingers (see FIG. 7). Sloped surface 32 may be advantageous, for example, to a player playing country music when the player is desirous of moving his thumb out of depression 15C and onto sloped surface 32 in the direction of arrow 33. An additional side depression 15A and one horizontal depression 15B may also be used with the embodiment shown in FIG. 2B.

Figure 2C:
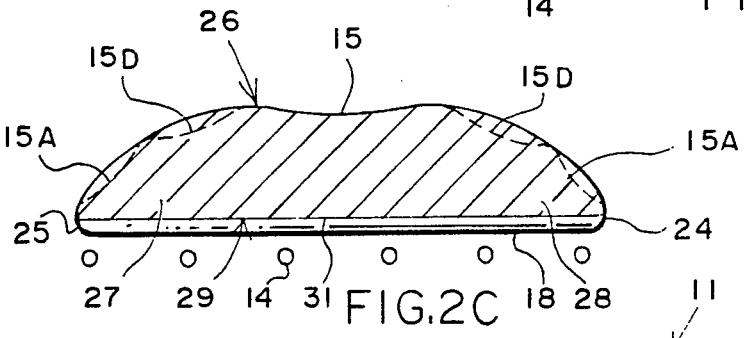
FIG. 2C is a cross-sectional, transverse view of another embodiment of a neck construction of the musical instrument of FIG. 1.

FIG. 2C shows yet another embodiment of the present invention. In this embodiment, the depressions 15 and 15A are as per the embodiment of FIG. 2A and serve the same purpose as previously described. A further slanted depression 15D is provided between depression 15 and one side depression 15A. Depression 15D provides a player with the opportunity to choose a thumb position substantially half-way between depressions 15 and 15A, but in a slanted direction.

Figure 2D:
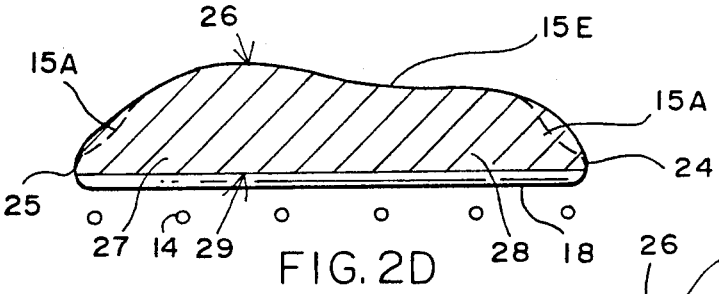
FIG. 2D is a cross-sectional, transverse view of another embodiment of a neck construction of the musical instrument of FIG. 1.

FIG. 2D illustrates another configuration that the inventive neck 11 may take according to the present invention. In this embodiment, a slanted center depression 15E is provided. Optional side depressions 15A may also be used. Slanted center depression 15E provides a player with a slanted surface much the same as in the embodiment of FIG. 2B, but moves the centermost curved portion of the depression 15E in the direction of side edge 24. The centermost curved portion of depression 15E allows a player to feel the center location of depression 15E which is biased toward side edge 24.

Figure 2E:
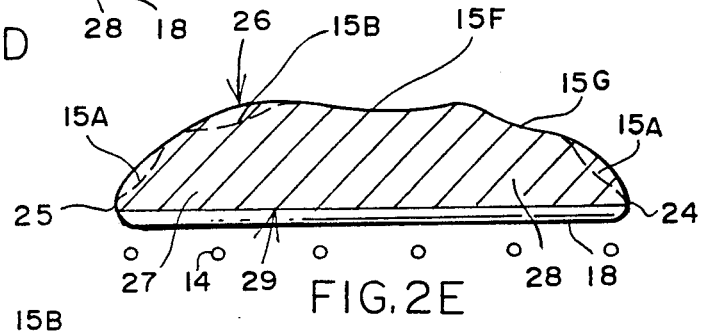
FIG. 2E is a cross-sectional, transverse view of another embodiment of a neck construction of the musical instrument of FIG. 1.

FIG. 2E illustrates yet another embodiment of the present invention. In this embodiment, a slanted center depression 15F is used similar to depression 15E of FIG. 2D but depression 15F is not as deep as that of depression 15E. A lesser depth of slanted center depression provides additional surface for another straight side depression 15G which is located between depressions 15A and 15F. Depressions 15A and 15B are also an option with this embodiment.

Figure 2F:
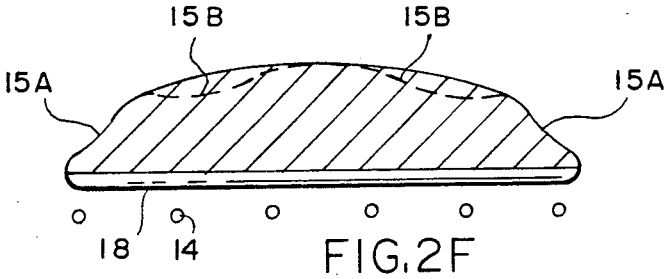
FIG. 2F is a cross-sectional, transverse view of another embodiment of a neck construction of the musical instrument of FIG. 1.

FIG. 2F illustrates another embodiment of the present invention. Here, optional horizontal side depressions 15B and slanted side depressions 15A are utilized. No center depression is utilized.

Figure 2G:
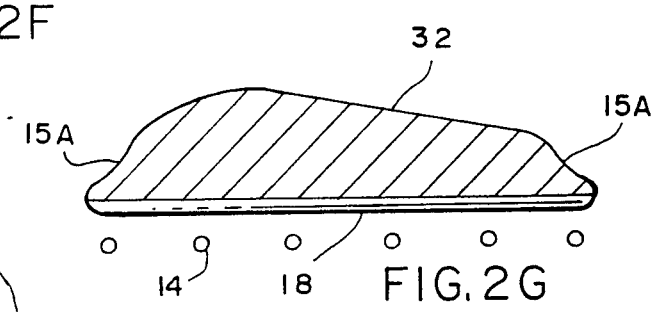
FIG. 2G is a cross-sectional, transverse view of another embodiment of a neck construction of the musical instrument of FIG. 1.

FIG. 2G illustrates another embodiment of the present invention. In this embodiment, no center depression is used with straight slanted surface 32. Side edge depressions 15A may be utilized.

For a left handed player, the various groove shapes and locations shown in FIGS. 2A through 2G would be mirror images thereof.

The various depressions shown in FIGS. 2A through 2G thereby provide a player with a substantial choice of differently located depressions all of which extend in a straight line along the longitudinal length of the neck 11 of a stringed musical instrument 10 while the player slides his hand along the length of the neck 11 of the instrument 10. Also, depressions 15–15G fit the convexly curved portion of a player's thumb and provide guide surfaces and fit-up space for the heel pads of the player's fingers as shown in FIGS. 5, 6 & 7.

In FIG. 3 a plurality of marks 41 are provided along the axial length of depression 15. Marks 41 substantially coincide in location with or between frets 18 and allow a player to determine fret 18 locations by using his thumb within depression 15.

In accordance with the above, one or more differently shaped and positioned depressions and a sloped surface are provided on the back side of the neck of a musical instrument such as a guitar. Such depressions and sloped surface allow a player to choose that embodiment or feature of that embodiment which best fits his particular style of playing the musical instrument or in accordance with the type of music being played. Further, the plurality of depressions allow the player to rotate his hand as he presses against the strings 14 when sliding his hand from the tuning end 12 of the neck 11 to the body end 16 of neck 11 and yet achieve a reference point for the location of his thumb.

Figure 5:
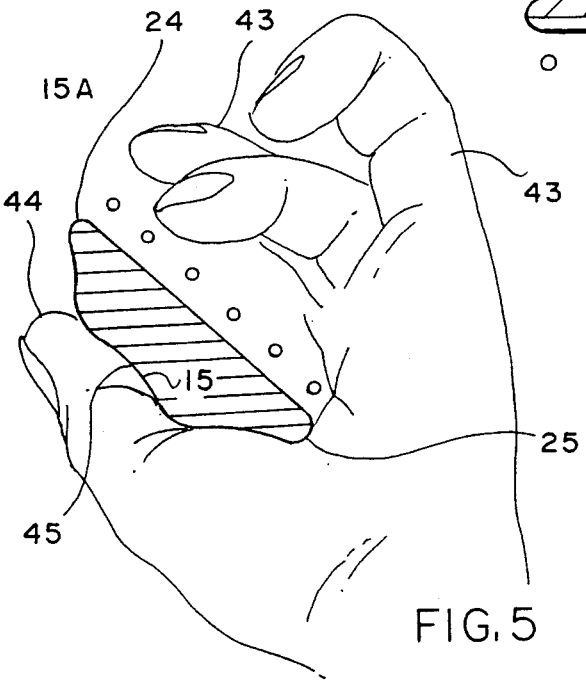
FIG. 5 is a schematic illustration of the location of a player's hand with his thumb utilizing a central depression.
Figure 6:
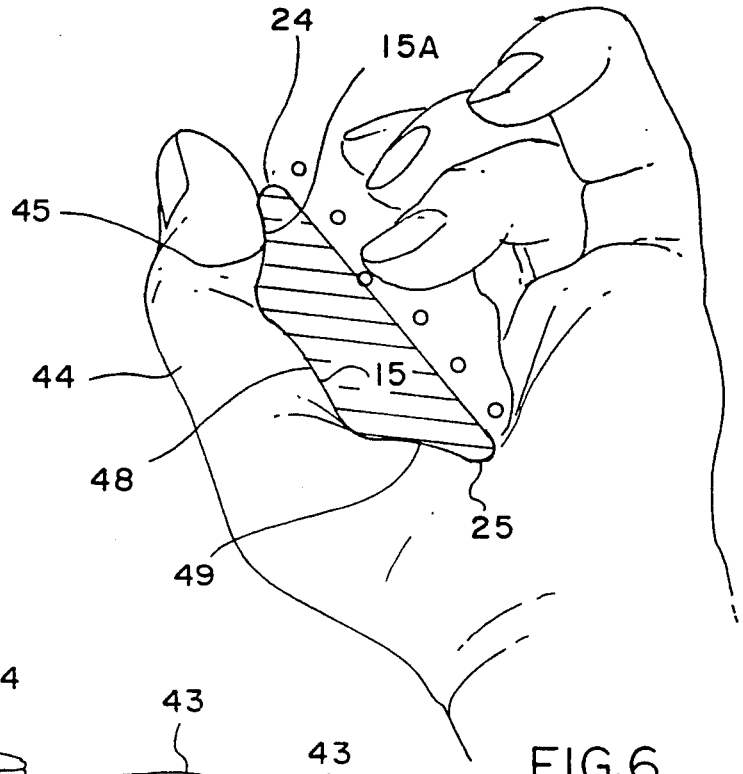
FIG. 6 is a schematic illustration of a player's hand with his thumb utilizing a side edge depression.
Figure 7:
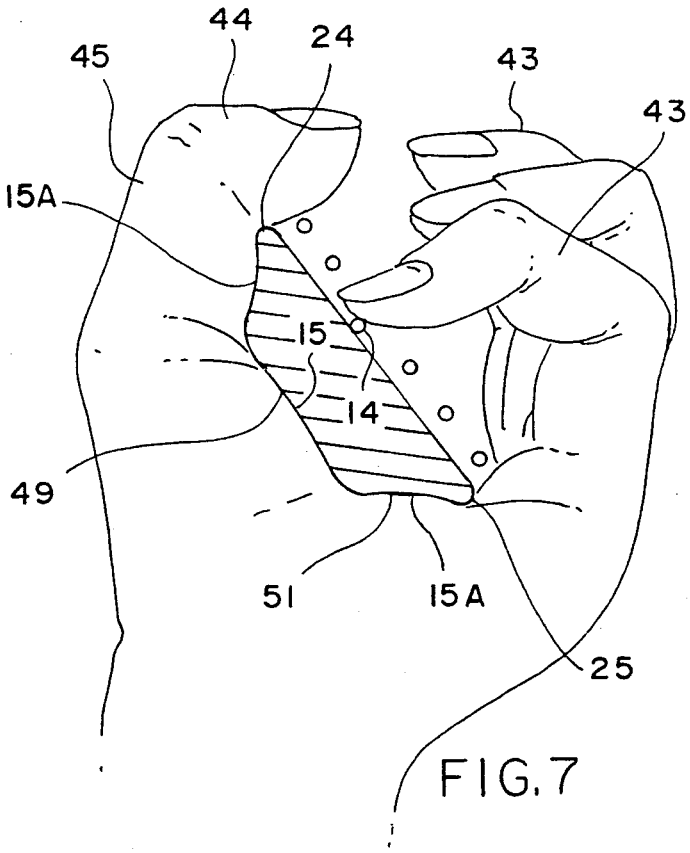
FIG. 7 is a schematic illustration of a player's hand with his thumb positioned over the top edge of the neck of the guitar.

FIGS. 5 and 6 illustrate the location of a player's hand 42 with his thumb utilizing a central depression 15 and a side edge depression 15A, respectively, of the cross-sectional neck embodiment of FIG. 2A. The location of the player's thumb 44 and fingers 43 are shown in these figures. In FIG. 5, the convexly curved portion 45 of the thumb 44 fits within depression 15. In FIG. 6, the convexly curved portion 45 of the thumb 44 fits within depression 15A of side edge 24 while the lower pad 48 of the second joint of the thumb fits within the depression 15A of side edge 24 and with fingers 43 pressing against strings 14. Moreover, the thumb heel pad 49 fits up against and within depression 15A at side edge 25.

In FIG. 7, the same neck construction of FIG. 2A is illustrated. In this instance, the player curls his thumb over and around the top side edge 24 of guitar 10. His second joint thumb pad fits within depression 15A; his thumb heel pad fits within depression 15; and, his finger pad 51 fits within depression 15A at lower side edge 25. One of the player's fingers 43 is shown pressing against a single string 14.

The exact depth and location of the various depressions and sloped surface provided herein may vary without departing from the intent and scope of the present invention.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. A neck construction for a guitar or bass guitar comprising:

a single elongated neck member having a first longitudinally extending upper surface and a second longitudinally extending lower surface, one or more depressions in said lower second surface extending parallel to a longitudinal axis of said neck for substantially the entire length of said neck, said one or more depressions having a concave cross-sectional shape, in a direction transverse to the longitudinal length of said neck, configured to approximate a convex shape of a person's thumb.

2. The neck construction of claim 1 wherein said one or more depressions include a first concave depression substantially centered relative to a transverse width of said neck.

3. The neck construction of claim 2, wherein said one or more depressions include a second concave depression located between a longitudinal extending side edge of said neck and said first concave depression, whereby said depressions alternatively are adapted to fit either a convex curvature of a person's thumb, a pad of the second joint of the thumb, a thumb's heel pad or finger pads.

4. The neck construction of claim 3, including a third concave depression located between said first and second concave depressions.

5. The neck construction of claim 4 wherein said third concave depression includes a transverse axis extending substantially parallel in a direction transverse to the longitudinal axis of the neck.

6. The neck construction of claim 4 wherein said third concave depression includes a transverse axis angled downward, in a direction transverse to the longitudinal axis to the neck, toward said extending side edge.

7. The neck construction of claim 3 wherein said substantially centered depression includes a transverse axis extending substantially parallel to a transverse axis of said first upper surface in a direction transverse to the longitudinal axis of the neck.

8. The neck construction of claim 3 wherein said substantially centered depression includes a transverse axis angled downward, relative to a transverse axis of said first upper surface in a direction transverse to the longitudinal axis of said neck, toward said extending side edge.

9. The neck construction of claim 3 wherein said second concave depression includes a transverse axis angled downward, relative to a transverse axis of said first upper surface, in a direction transverse to the longitudinal axis of said neck, toward said extending side edge.

10. The neck construction of claim 1 wherein said one or more depressions comprise, in a transverse direction, at least one depression having a transverse axis substantially parallel relative to a transverse axis of said first upper surface and at least one depression, having a transverse axis angled downward relative to a transverse axis of said first upper surface each located between a longitudinal center and a longitudinal side edge of said neck.

11. The neck construction of claim 1 wherein said one or more depressions each include a transverse axis angled downward relative to a transverse axis of said upper surface.

12. The neck construction of claim 1 wherein said one or more depressions include a center depression offset toward one longitudinal side edge of said neck.

13. The neck construction of claim 12 including a second horizontal depression offset toward a second opposite longitudinal side edge of said neck.

14. The neck construction of claim 1 wherein said neck member is proportioned to be fitted with a plurality of substantially equal length strings extending along the longitudinal length of said neck.

15. The neck construction of claim 1 wherein at least one or more of said depressions is of a substantially constant depth along the length of said neck.

16. The neck construction of claim 1 wherein said one or more depressions include a first concave depression located between a longitudinal center axis of said neck and a longitudinal side edge of said neck.

17. The neck construction of claim 1 wherein said second lower surface includes a slanted surface offset between a longitudinal center axis and a longitudinal side edge of said neck, said surface angling downward in a direction transverse to and from the longitudinal center axis toward said side edge.

18. The neck construction of claim 1 including a plurality of marks, extending along and on said second longitudinally extending lower surface, said marks being spaced from each other and being oriented relative to fret markings on said first upper surface of said neck.

19. The neck construction of claim 18 wherein said plurality of marks are located substantially between said fret markings.

20. The neck construction of claim 18 wherein said plurality of marks are located substantially at the same axial location of said fret markings.

* * * * *